US009494351B2

(12) United States Patent
Phillippe et al.

(10) Patent No.: US 9,494,351 B2
(45) Date of Patent: Nov. 15, 2016

(54) METHOD AND APPARATUS FOR IMPROVING REFRIGERATION AND AIR CONDITIONING EFFICIENCY

(76) Inventors: Gary E. Phillippe, North Highlands, CA (US); Cass Khoo, Alameda, CA (US)

( * ) Notice: Subject to any disclaimer, the term of this patent is extended or adjusted under 35 U.S.C. 154(b) by 1423 days.

(21) Appl. No.: 14/384,600

(22) PCT Filed: Apr. 23, 2010

(86) PCT No.: PCT/US2010/032148
§ 371 (c)(1),
(2), (4) Date: Jan. 3, 2015

(87) PCT Pub. No.: WO2010/124153
PCT Pub. Date: Oct. 28, 2010

(65) Prior Publication Data

US 2015/0135766 A1 May 21, 2015

Related U.S. Application Data

(60) Provisional application No. 61/171,924, filed on Apr. 23, 2009, provisional application No. 61/171,919, filed on Apr. 23, 2009, provisional application No. 61/297,528, filed on Jan. 22, 2010.

(51) Int. Cl.
*F25B 1/00* (2006.01)
*F25B 41/00* (2006.01)
*F25B 40/02* (2006.01)

(52) U.S. Cl.
CPC ..... *F25B 41/00* (2013.01); *F25B 1/00* (2013.01); *F25B 40/02* (2013.01); *F25B 2400/02* (2013.01); *F25B 2400/04* (2013.01); *F25B 2400/16* (2013.01)

(58) Field of Classification Search
CPC ..... F25B 40/02; F25B 41/00; F25B 1/00; F25B 2400/04; F25B 2400/16; F25B 2400/02
USPC ..... 62/509
See application file for complete search history.

(56) References Cited

U.S. PATENT DOCUMENTS 4,173,865 A * 11/1979 Sawyer ..... F24F 11/085 62/160
4,187,695 A * 2/1980 Schumacher ..... F25B 41/00 62/116
4,194,371 A * 3/1980 Morse ..... F04B 39/064 62/503
4,357,805 A * 11/1982 Manning ..... F25B 5/00 62/117
4,359,879 A * 11/1982 Wright ..... B01D 53/265 165/143

(Continued)

*Primary Examiner* — Mohammad M Ali
(74) *Attorney, Agent, or Firm* — Sumana Prabhu

(57) ABSTRACT

A method and apparatus for improving refrigeration and air conditioning efficiency for use with a heat exchange system having a compressor, condenser, evaporator, expansion device, and circulating refrigerant. The apparatus includes is a liquid refrigerant containing vessel having a refrigerant entrance and a refrigerant exit with the vessel positioned in the heat exchange system between the condenser and the evaporator, and means for creating a turbulent flow of liquefied refrigerant. The apparatus further preferably includes a refrigerant bypass path to sub-cool a portion of the refrigerant within the vessel; a disk positioned at the liquid refrigerant entrance to develop a low pressure area on the back side and create a turbulent flow of refrigerant entering the vessel; and a refrigerant valve incorporated into the refrigerant path downstream of the expansion valve and before the coil which develops a vortex that continues through the refrigerant coil.

10 Claims, 2 Drawing Sheets

(56) References Cited

U.S. PATENT DOCUMENTS 4,370,868 A * 2/1983 Kim ..... F25B 39/022 165/153
4,651,540 A * 3/1987 Morse ..... F25B 43/006 55/441
5,551,253 A * 9/1996 Kim ..... F25B 31/004 55/326
5,553,460 A * 9/1996 Isaacs ..... B01D 45/16 62/129
2005/0022551 A1* 2/2005 Barratt ..... B01D 45/06 62/471
2006/0280622 A1* 12/2006 Lee ..... F25B 43/02 417/313
2007/0251264 A1* 11/2007 Jang ..... F25B 43/02 62/470

* cited by examiner

METHOD AND APPARATUS FOR IMPROVING REFRIGERATION AND AIR CONDITIONING EFFICIENCY

CROSS REFERENCE TO RELATED APPLICATIONS

The present application claims the benefit of the filing date of U.S. Provisional Patent Application Ser. No. 61/171,919, filed Apr. 23, 2009; U.S. Provisional Patent Application Ser. No. 61/171,924, filed Apr. 23, 2009; and U.S. Provisional Patent Application Ser. No. 61/297,528, filed Jan. 22, 2010. The foregoing applications are incorporated by reference in their entirety as if fully set forth herein.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to refrigeration and air conditioning, and particularly to an improved method and apparatus for improving refrigeration and air conditioning efficiency. More specifically, by relying on principles of fluid mechanics and turbulent flow of a refrigerant, the inventive apparatus achieves maximum refrigerant operational conditions while reducing energy consumption by the system.

BACKGROUND INFORMATION AND DISCUSSION OF RELATED ART

Various devices relying on standard refrigerant recycling technologies have been available for many years, such as refrigeration and heat pump devices, having both cooling and heating capabilities. Within the limits of each associated design specification, heat pump devices enable a user to cool or heat a selected environment or with a refrigeration unit to cool a desired location. For these heating and cooling duties, in general, gases or liquids are compressed, expanded, heated, or cooled within an essentially closed system to produce a desired temperature result in the selected environment.

Traditional sub-coolers partially cool the refrigerant prior to the expansion device and subsequent evaporator. Such refrigerant cooling has been shown to increase the efficiency of the heat transfer within the evaporator. Various types of sub-coolers exist, but the most common form cools the refrigerant by drawing in cooler liquid to surround the warmer refrigerant.

U.S. Pat. No. 5,259,213 to applicant herein discloses a heat pump efficiency enhancer for use with a heat pump to increase cooling and heating efficiency, between an outdoor condenser and an indoor evaporator. A refrigerant receiver or sub-cooler is provided within the high pressure liquid refrigerant portion of the system, including at least one high flow, low pressure release check valve having an internal control element with a refrigerant turbulence producing backside that serves as an incremental expansion device to cool, by incremental expansion, and heat, by turbulence, the high pressure liquid refrigerant.

U.S. Pat. No. 5,426,956 to applicant herein describes a refrigerant system efficiency amplifying apparatus for use with a heat exchange system having a compressor, condenser, evaporator, expansion device, and circulating refrigerant. The apparatus includes a liquid refrigerant containing vessel having a refrigerant entrance and a refrigerant exit with the vessel positioned in the heat exchange system between the condenser and the evaporator, and means associated with the vessel for creating a turbulent flow of liquefied refrigerant.

U.S. Pat. No. 5,727,398 to applicant herein teaches a refrigerant agitation apparatus having a turbulent flow generating apparatus for use with a refrigerant containing heat exchange system that has a refrigerant carrying line. The invention includes at least one housing fitted into the refrigerant carrying line and within each housing a refrigerant agitating mechanism comprising at least one bladed disk that induces refrigerant agitation as the refrigerant flows through the apparatus.

U.S. Pat. Nos. 6,401,470 and 6,401,471 to Wightman disclose an expansion device for a vapor compression system. The vapor compression system includes a line for flowing heat transfer fluid, a compressor connected with the line for increasing the pressure and temperature of the heat transfer fluid, a condenser connected with the line for liquefying the heat transfer fluid, and an expansion device connected with the line for expanding the heat transfer fluid. The expansion device includes a housing defining a first orifice, and at least one blade connected with the housing, wherein the blade is movable between a first position and a second position, wherein the first orifice is larger in the first position than in the second position. The vapor compression system also includes an evaporator connected with the line for transferring heat from ambient surroundings to the heat transfer fluid.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides an improved method and apparatus for improving refrigeration and air conditioning efficiency, for use with a heat exchange system (e.g., refrigeration or heat pump devices) having at least a compressor, condenser, evaporator, expansion device, and circulating refrigerant. The inventive efficiency enhancing apparatus comprises a liquid refrigerant containing vessel formed from a cylinder capped by a top end cap and a bottom end cap, wherein the vessel is positioned in the heat exchange system between the condenser and the evaporator. A refrigerant entrance is located in a top region of the vessel and a refrigerant exit is located in a bottom region of the vessel. Preferably, the refrigerant exit is positioned to be no lower than approximately a lowest point in the condenser.

The apparatus may include a first means for generating turbulence in the refrigerant associated with the top region and second means for generating turbulence in the refrigerant associated with the bottom region. For example, the first means may comprise means for generating a rotational motion of the entering refrigerant within the vessel. The second means may comprise a set of fixed angle blades positioned in the bottom region of the vessel. The set of blades produces turbulence in the refrigerant as the refrigerant exits the vessel. More particularly, the second means may comprise a disk located proximate the refrigerant exit, a central aperture formed in the disk that permits the passage of exiting refrigerant, and a set of fixed angled blades formed in the disk that project into the central aperture, wherein the set of blades adds turbulence to the exiting refrigerant, all as described in U.S. Pat. No. 5,426,956 by applicant herein, the disclosure of which is hereby incorporated by reference in its entirety as if fully set forth herein.

The inventive apparatus further preferably includes a refrigerant bypass path to sub-cool a portion of the refrigerant within the vessel. A disk positioned at the liquid refrigerant entrance may include an aperture connected to a bypass tube extending into the center of the vessel, which terminates in at least one bypass exit port releasing the bypass refrigerant across a heat exchanger, and reintroduces the bypass refrigerant to the refrigerant stream at the bottom of the vessel.

In a preferred embodiment, the disk positioned at the liquid refrigerant entrance comprises an incremental expansion device disk. The disk develops a low pressure area on the back side and creates a turbulent flow of the refrigerant entering the vessel (other than the bypass path), thereby improving refrigerant efficiency.

In another preferred embodiment, the system may include a refrigerant valve device incorporated into the refrigerant path downstream of the expansion valve and before the coil. The refrigerant valve preferably includes an incremental expansion device disk which develops a low pressure area on the back side. The refrigerant is then focused in a spiral manner by a set of fixed planes. This develops a vortex that continues through the refrigerant coil, insuring uniform flow through the coil to increase coil efficiency and reduce refrigerant pooling. A heat exchanger on the outside of the refrigerant valve may be used to remove any heat the expansion device captures. Alternatively, and instead of a traditional heat exchanger, heat removal can be accomplished by coating the refrigerant valve device in diamonds.

It is therefore an object of the present invention to provide a new and improved refrigerant system efficiency amplifying apparatus.

It is another object of the present invention to provide a new and improved apparatus that decreases the amount of energy required to power a compressor in a refrigeration of heat pump system.

A further object or feature of the present invention is a new and improved apparatus that decrease the compression ratio for a compressor in a refrigeration of heat pump system, thereby increasing the efficiency and economy of the system.

An even further object of the present invention is to provide a novel apparatus that introduces turbulent flow into the liquefied refrigerant within a refrigeration or heat pump system, thus increasing the operational conditions for the refrigerant that favor enhancing efficiency of the system.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the international, regional, and national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
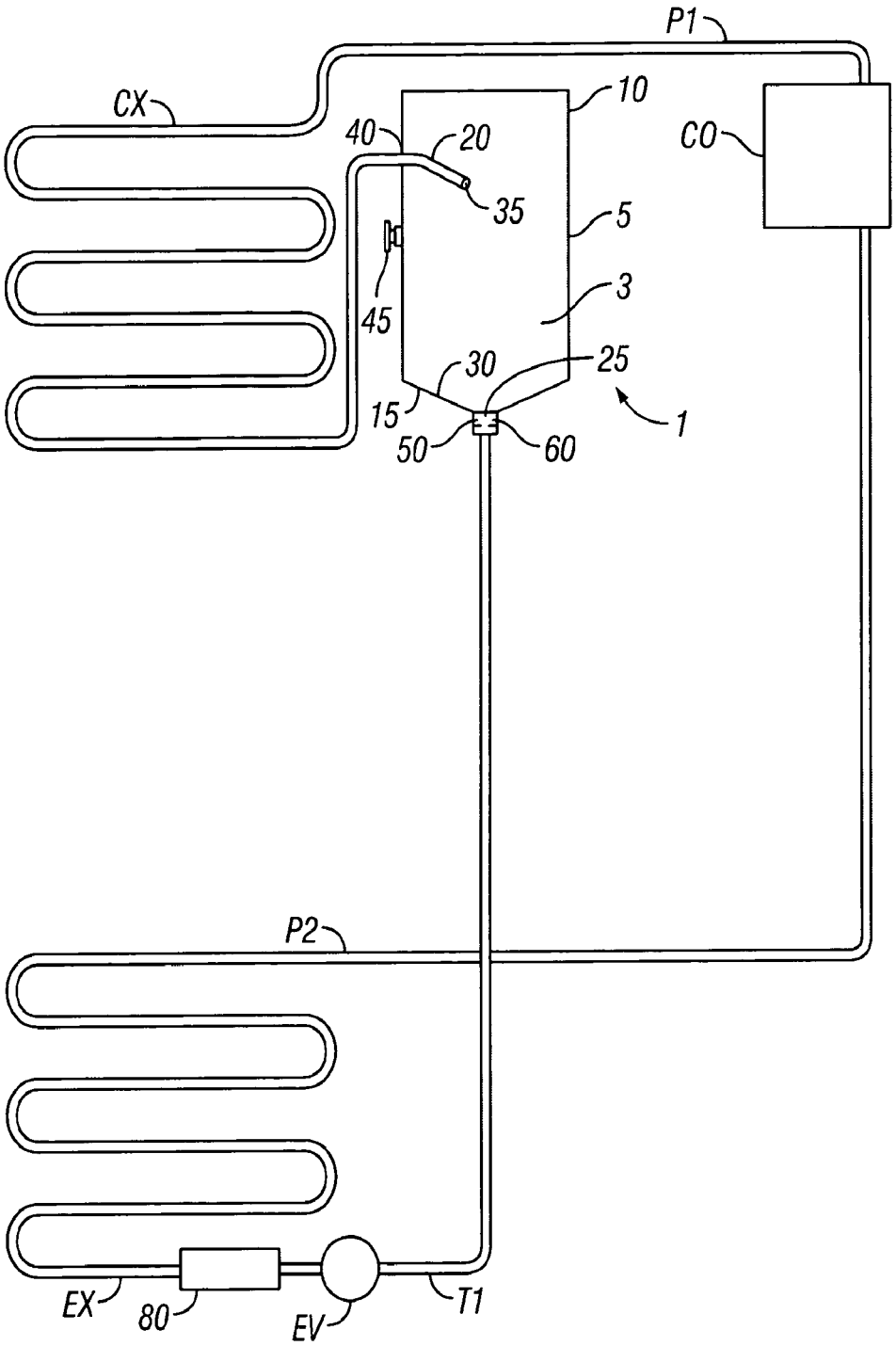
FIG. 1 is a schematic view of a refrigeration system adapted with the invention disclosed in applicant's U.S. Pat. No. 5,426,956.

By way of introduction to the environment in which the inventive system operates, the following is a brief description of the functioning of a traditional refrigeration system.

An expandable-compressible refrigerant is contained and cycled within an essentially enclosed system comprised of various refrigerant manipulating components. When a liquid refrigerant expands (within a heat exchanger or evaporator) to produce a gas it increases its heat content at the expense of a first surrounding environment which decreases in temperature. The heat rich refrigerant is transported to a second surrounding environment and the heat content of the expanded refrigerant released to the second surroundings via condensation (within a heat exchanger or condenser), thereby increasing the temperature of the second surrounding environment. As indicated, even though the subject invention is used preferably with a refrigeration system, adaptation to a generalized heat pump system is also contemplated. Therefore, for a heat pump, heating or cooling conditions are generated in the first and second environments by reversing the process within the enclosed system.

The four basic components in all systems are: a compressor; a condenser (heat exchanger); an evaporator (heat exchanger); an expansion valve; and the necessary plumbing to connect the components. These components are the same regardless of the size of the system. Gaseous refrigerant is compressed by the compressor and transported to the condenser which causes the gaseous refrigerant to liquefy. The liquid refrigerant is transported to the expansion valve and permitted to expand gradually into the evaporator. After evaporating into its gaseous form, the gaseous refrigerant is moved to the compressor to repeat the cycle.

A lower compression ratio reflects a higher system efficiency and consumes less energy during operation. During compression the refrigerant gas pressure increases and the refrigerant gas temperature increases. When the gas temperature/pressure of the compressor is greater than that of the condenser, gas will move from the compressor to the condenser. The amount of compression necessary to move the refrigerant gas through the compressor is called the compression ratio. The higher the gas temperature/pressure on the condenser side of the compressor, the greater the compression ratio. The greater the compression ratio the higher the energy consumption. Further, the energy (Kw) necessary to operate a cooling or heat exchange system is primarily determined by three factors: the compressor's compression ratio; the refrigerant's condensing temperature; and the refrigerant's flow characteristics.

The compression ratio is determined by dividing the discharge pressure (head) by the suction pressure. Any change in either suction or discharge pressure will change the compression ratio.

It is noted that for refrigeration systems or any heat pump systems when pressure calculations are performed they are often made employing absolute pressure units (PSIA), however, since most individuals skilled in the art of heat pump technologies are more familiar with gauge pressure (PSIG), gauge pressures are used as the primary pressure units in the following exemplary calculations. In a traditional refrigeration system, a typical discharge pressure is 226 PSIG (241 PSIA) and a typical suction pressure is 68 PSIG (83 PSIA). Dividing 226 PSIG by 68 PSIG yields a compression ratio of about 2.9.

The condensing temperature is the temperature at which the refrigerant gas will condense to a liquid, at a given pressure. Well known standard tables relate this data. In a traditional example, using R22 refrigerant, that pressure is 226 PSIG. This produces a condensing temperature of 110 degrees F. At 110 degrees F., each pound of liquid freon that passes into the evaporator will absorb 70.052 Btu's. However, at 90 degrees F. each pound of freon will absorb 75.461 Btu's. Thus, the lower the temperature of the liquid refrigerant entering the evaporator the greater its ability to absorb heat. Each degree that the liquid refrigerant is lowered increases the capacity of the system by about one-half percent.

Well known standard tables of data that relate the temperature of a liquid refrigerant to the power required to move Btu's per hour show that if the liquid refrigerant is at 120 degrees F., 0.98 hp will move 22873 Btu's per hour. If the liquid refrigerant is cooled to 60 degrees F., only 0.2 hp is required to move 29563 Btu's per hour.

Additionally, refrigerant flow through the refrigerant system, in most heat pump systems, is laminar flow. Traditional systems are designed with this flow in mind. However, a turbulent flow is much more energy efficient as is known from well established data tables.

Referring now to FIG. 1, there is shown a schematic view of a refrigeration system adapted with the invention disclosed in applicant's U.S. Pat. No. 5,426,956. Components of that system include compressor CO; condenser CX; evaporator EX; and expansion valve EV, with the device of the '956 patent fitted into the system between the condenser CX and the evaporator EX. The system stores excess liquid refrigerant (that is normally stored in the condenser) in a holding vessel 1, thus giving an increased condensing volume (usually approximately 20% more condensing volume), thereby cooling the refrigerant more (a type of sub-cooling). By adding this extra cooling the system reduces the discharge pressure and suction pressure. For discharge at P1 the pressure is 168 PSIG (183 PSIA) and for suction at P2 the pressure is 60 PSIG (74 PSIA). With these discharge and suction pressures, the compression ratio calculates to be 2.5. For the traditional refrigeration system, the previously calculated compression ratio was 2.9. This shows a reduction in compression work of about 17%.

Concerning the condensing temperature for the adapted system, the liquid refrigerant temperature at T1 is about 90 degrees F. (lowered from the 110 degrees F. noted above for the traditional system). The 20 degrees F. drop in liquid refrigerant temperature yields a 10% increase in system capacity (20 degrees F. times one-half percent for each degree, as indicated above). This was accomplished by the increased condensing volume provided by the subject device.

The device influences the flow of the liquid refrigerant. Normally, when a vessel is introduced into a fixed pressure system (usually, for sub-cooling) a reduction in the system's capacity occurs because most fixed head pressure systems utilize a fixed orifice or capillary type expansion device. Such devices require pressure to force a proper volume of refrigerant through them in order to maintain capacity. The pressure is generated by the compressor. The greater the demand for pressure the greater the demand for energy (Kw).

With the adaptation of a floating head pressure heat pump system by the subject device, the capacity is maintained. The capacity is maintained due to increased refrigerant velocity, volume, and refrigerant Btu capacity because of lower condensing temperature and an introduced spiral turbulent flow, rather than a straight laminar flow. As is well know in fluid dynamics, turbulent flow has an average velocity that is far more uniform than that for laminar flow. In fact, far from being a parabola, as in laminar flow, the distribution curve of the boundary region for a flowing liquid with turbulent flow is practically logarithmic in form. Thus, for turbulent motion, at the boundaries where the eddy motion must reduce to a minimum, the velocity gradient is much higher than in laminar type flow. With the device and its influence on refrigerant flow, the hotter the condensing temperature and the higher the load, the better the adapted system functions.

The vessel 1 has an internal volume 3 and is preferably fabricated from a cylinder 5 and top 10 and bottom 15 end caps of suitable material such a metal, metal alloy, or natural or synthetic polymers. Generally, the top 10 and bottom 15 end caps are secured to the cylinder 5 by appropriate means such as soldering, welding, brazing, gluing, threading and the like, however, the entire vessel 1 may be formed from a single unit with the cylinder 5 and top 10 and bottom 15 end caps as a unitized construction.

A liquid refrigerant entrance 20 and a liquid refrigerant exit 25 penetrate the vessel 1. Preferably, the refrigerant entrance 20 is located in a top region of the vessel 1. The top region is defined as being approximately between a midline of the cylinder 5, bisecting the cylinder 5 into two smaller cylinders, and the top end cap 10. Although FIG. 1 depicts the refrigerant entrance 20 as penetrating the cylinder 5, the entrance may penetrate the top end cap 10. Preferably, the refrigerant exit 25 is located in a bottom region of the vessel 1. The bottom region of the vessel 1 is defined as being approximately between the midline, above, and the bottom end cap 15. Although other locations are possible, the refrigerant exit 25 is preferably located proximate the center of the bottom end cap 15.

Usually, the bottom end cap 15 has an angled or sloping interior surface 30. However, the bottom end cap 15 may have an interior surface of other suitable configurations, including being flat.

Liquid refrigerant liquefied by the condenser CX enters into the vessel 1 via the refrigerant entrance 20 and the associated components. The associated entrance components comprise a refrigerant delivery tube 35 and entrance fitting 40 that secures the vessel 1 into the exit portion of the plumbing coming from the condenser CX. The entrance fitting 40 is any suitable means that couples the subject device into the plumbing in the required position between the condenser CX and the evaporator EX.

The refrigerant delivery tube 35 is configured to generate rotational motion in the entering refrigerant. The tube 35 penetrates into the top region and is formed into a curved configuration and generally angled down to deliver the entering refrigerant along a path suitable for generating a rotational motion of the refrigerant within the vessel 1. Other equivalent configurations of the tube 35 that generate such a rotational refrigerant motion are contemplated to be within the realm of the invention.

To view the level of the liquid refrigerant within the vessel 1, a sight glass 45 is provided. The glass 45 is mounted in the cylinder 5 at a position to note the refrigerant level.

The refrigerant exit 25 is comprised of an exit tube and fitting 50 that secures the subject device into the plumbing of the system. The exit fitting 50 is any suitable means that couples the subject device into the plumbing in the required position between the condenser CX and the evaporator EX.

A second means for introducing a turbulent flow into the exiting liquefied refrigerant is mounted proximate the exit 25. A "turbulator" 60 is held in place by cooperation between the exit tube and fitting 50 or any other equivalent means. The turbulator is usually a separate component that is secured within the components of the exit from the vessel 1, however, the turbulator may be an integral part of the vessel 1 refrigerant exit. The turbulator comprises a disk with a central aperture and at least one fixed angle blade formed or cut into the disk. Preferably, a set of fixed angle blades are provided to add turbulence to the exiting refrigerant.

The blades are angled to induce rotational, turbulent motion of the liquid refrigerant as the refrigerant exits the vessel 1. Various angles for the blades are suitable for generating the required turbulence.

Preferably, the subject vessel 1 is placed in the adapted system so that the refrigerant exit 25 is no lower than the lowest portion of the condenser CX. Liquid refrigerant from the condenser CX enters the vessel 1 and is directed into a swirling motion about the interior volume 3 by the delivery tube 35. The swirling liquid refrigerant leaves the vessel 1 by means of the refrigerant exit 25 and then encounters the turbulator 60. The blades of the turbulator 60 add additional turbulence into the flow of the refrigerant.

Figure 2:
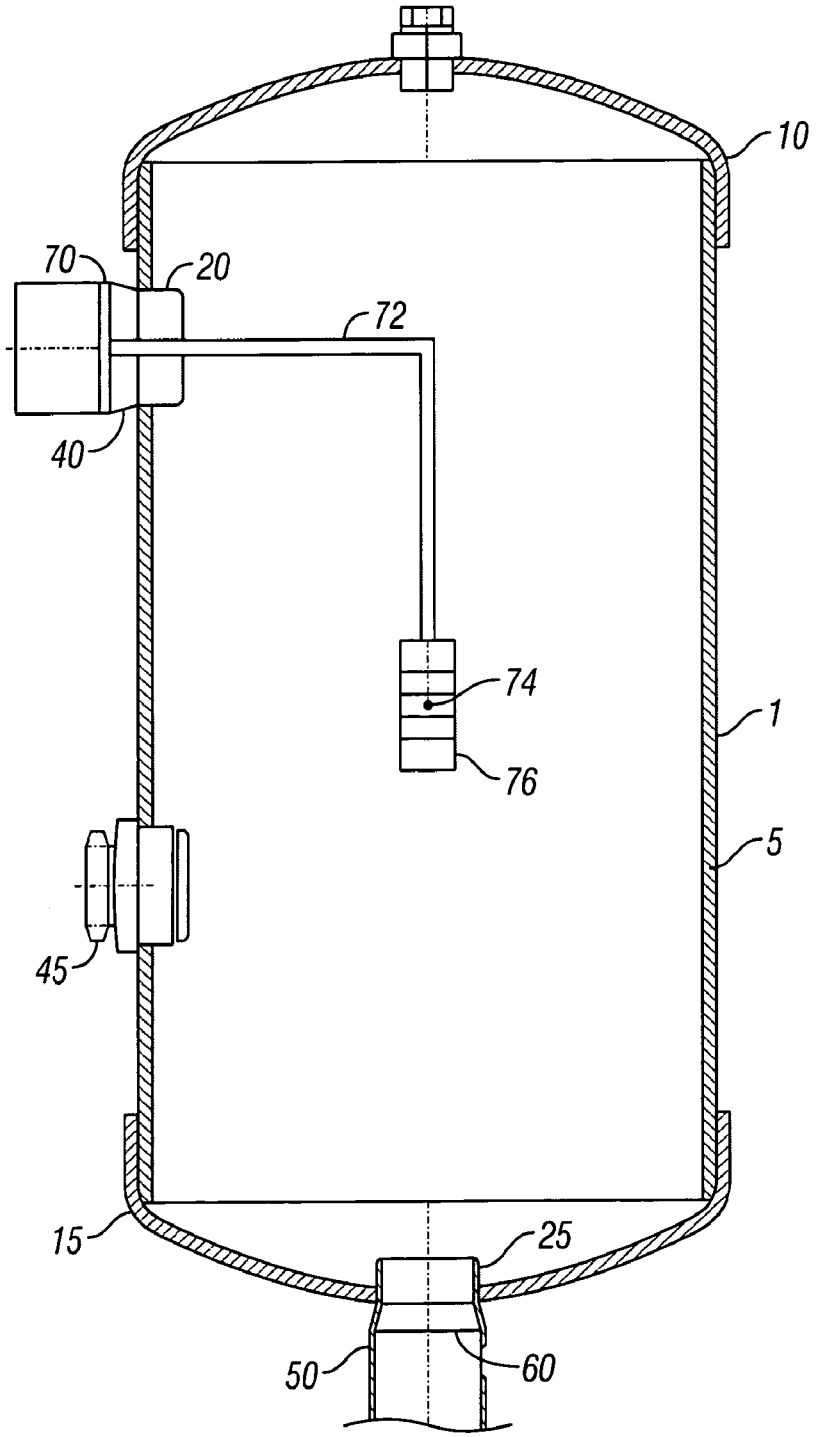
FIG. 2 is a cross-sectional view of a refrigerant bypass path apparatus for the inventive system.

FIG. 2 is a cross-sectional view of the inventive refrigerant bypass path apparatus for the system, used to sub-cool a portion of the refrigerant within the vessel 1. A disk 70 positioned at the liquid refrigerant entrance 20 may include an aperture connected to a bypass tube 72 extending into the center of the vessel, which terminates in at least one bypass exit port 74 releasing the bypass refrigerant across a heat exchanger 76, thereby reintroducing the bypass refrigerant to the rest of the refrigerant stream at the bottom of the vessel.

After the refrigerant enters the vessel and starts to exit, it develops a shallow-well vortex at the bottom of the vessel 1. In the center of the shallow-well vortex, it develops a low-pressure area. The stronger the vortex, which increases as it becomes hotter, the greater the low-pressure area in the center of the vortex, thereby being able to sub-cool the refrigerant that passes over the heat exchanger 76 at the bottom of the bypass tube 72.

With the development of the low-pressure area in the center of the vortex, the small amount of refrigerant entering the bypass path at the liquid refrigerant entrance 20 expands and comes out at the bypass path exit port 74 to sub-cool the refrigerant and allow the heat bubbles carried by the refrigerant to continue to condense so as to allow the refrigerant that is delivered downstream to the expansion valve to have less non-condensed refrigerant within it, thereby improving the operation of the system.

In a preferred embodiment, the disk 70 positioned at the liquid refrigerant entrance 20 comprises an incremental expansion device disk. The disk develops a low pressure area on the back side and creates a turbulent flow of refrigerant entering the vessel, thereby improving refrigerant efficiency. The disk may be such as was disclosed above as turbulator 60 at the refrigerant exit; or disclosed in the heat pump efficiency enhancer of U.S. Pat. No. 5,259,213 (e.g., FIG. 4, valve plate 160 of that disclosure); or any other disk configuration that develops a low pressure area on the back side and creates a turbulent flow of refrigerant, which can be incorporated into the refrigerant entrance 20 of the vessel.

In another preferred embodiment, the system may include a refrigerant valve 80 incorporated into the refrigerant path downstream of the expansion valve and before the coil. The valve preferably includes an incremental expansion device disk which develops a low pressure area on the back side. The refrigerant is then focused in a spiral manner by a set of fixed planes. This develops a vortex that continues through the refrigerant coil, insuring uniform flow through the coil to increase coil efficiency and reduce refrigerant pooling. A heat exchanger is used to remove any heat the expansion device captures. Alternatively, and instead of a traditional heat exchanger, heat removal can be accomplished by coating the outside surface of the refrigerant valve device in diamonds (e.g., by applying heat sink epoxy to the copper substrate, and rolling the epoxy in diamond particles such as 20/30 grit).

With the addition of a condenser controller with adiabatic sub-cooling, it is possible to tune a refrigeration system using an adjustable thermostat expansion valve. Just as the thermostat expansion valve adjusts to varying conditions at the evaporator, this condenser control allows the condenser to be adjusted under varying conditions as well.

For example, a first option allows a properly sized system to meet its set point sooner and turn off. Open up the thermostat expansion valve to the evaporator, being sure not to reduce below a 10° super heat at the compressor. This will load the compressor amps to rated load, but not over load. The condenser will load up and the condenser control will fill with cool liquid refrigerant from the sub-cooling section of the condenser, giving more room for good condensing in the condenser.

A second option allows the system to run at a reduced amp load. Close up the thermostat expansion valve to reduce the load on the evaporator to the rated capacity, making sure not to exceed a 25° super heat at the compressor. This will unload the compressor to below rated amps. The condenser will have some sub-cooling and the condenser control will fluctuate the amount of refrigerant in or out of it, in order to balance pressure and temperature.

A third option allows the system to run at reduced amps at the compressor and the evaporator will run slightly over rated capacity, so as to reduce run time and meet set point sooner, then turn off. Adjust the thermostat expansion valve until the super heat at the compressor is at 15° to 18° superheat. The compressor will be running at reduced amps, the condenser will be doing some sub-cooling, and the condenser control will be fluctuating in order to balance temperature and pressure within the system.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. For use with a heat exchange system having a compressor, condenser, evaporator, expansion device, and circulating refrigerant, an efficiency enhancing apparatus comprising:

a liquid refrigerant containing vessel with a top region having a refrigerant entrance and a bottom region having a refrigerant exit, wherein said vessel is positioned in the heat exchange system between the condenser and the evaporator;

means associated with said vessel for creating a turbulent flow of liquefied refrigerant; and a refrigerant bypass path to sub-cool a portion of the refrigerant within said vessel, said bypass path comprising a bypass tube extending into the center of said vessel.

2. The efficiency enhancing apparatus of claim 1 wherein said bypass tube terminates in at least one bypass exit port.

3. The efficiency enhancing apparatus of claim 2 wherein said bypass tube includes a heat exchanger.

4. The efficiency enhancing apparatus of claim 1 wherein said turbulence creating means comprises a disk located proximate said refrigerant entrance, said disk permitting the passage of entering refrigerant; and a set of fixed angled blades formed in said disk, wherein said set of blades adds said turbulence to said entering refrigerant.

5. The efficiency enhancing apparatus of claim 1 further including a refrigerant valve incorporated into the refrigerant path downstream of the expansion valve and before the coil which develops a vortex that continues through the refrigerant coil.

6. For use with a heat exchange system having a compressor, condenser, evaporator, expansion device, and circulating refrigerant, an efficiency enhancing apparatus comprising:

a generally cylindrical liquid refrigerant containing vessel with a top region having a refrigerant entrance and a bottom region with a refrigerant exit, said refrigerant entrance comprising a disc that includes an aperture, wherein said vessel is positioned in the heat exchange system between the condenser and the evaporator;

first means for generating turbulence in the refrigerant associated with said top region;

second means for generating turbulence in the refrigerant associated with said bottom region; and a refrigerant bypass path to sub-cool a portion of the refrigerant within said vessel, said bypass path comprising a bypass tube extending into the center of said vessel.

7. The efficiency enhancing apparatus of claim 6 wherein said bypass tube terminates in at least one bypass exit port.

8. The efficiency enhancing apparatus of claim 7 wherein said bypass tube includes a heat exchanger.

9. The efficiency enhancing apparatus of claim 6 wherein said first means for generating turbulence comprises a disk located proximate said refrigerant entrance, said disk permitting the passage of entering refrigerant; and a set of fixed angled blades formed in said disk, wherein said set of blades adds said turbulence to said entering refrigerant.

10. The efficiency enhancing apparatus of claim 6 further including a refrigerant valve incorporated into the refrigerant path downstream of the expansion valve and before the coil which develops a vortex that continues through the refrigerant coil.

* * * * *